United States Patent [19]

Ishizaka

[11] Patent Number: 4,798,925

[45] Date of Patent: Jan. 17, 1989

[54] METHOD FOR MEASURING EFFECTIVE HEATING POWER FOR HIGH FREQUENCY HEATING

[75] Inventor: Yuji Ishizaka, Kanagawa, Japan

[73] Assignee: Kabushiki Kaisha Meidensha, Tokyo, Japan

[21] Appl. No.: 69,400

[22] Filed: Jul. 2, 1987

[30] Foreign Application Priority Data

Jul. 4, 1986 [JP] Japan ..... 61-156229
Oct. 20, 1986 [JP] Japan ..... 61-247602

[51] Int. Cl.[4] ..... H05B 6/06

[52] U.S. Cl. ..... 219/10.41; 219/8.5; 219/10.77

[58] Field of Search ..... 219/10.77, 10.43, 10.41, 219/8.5, 9.5, 110; 364/477, 472; 266/80, 96

[56] References Cited

U.S. PATENT DOCUMENTS 3,573,416 4/1971 Drechsler ..... 219/8.5
3,743,808 7/1973 Kasper ..... 219/10.41
4,280,038 7/1981 Hauas et al. ..... 219/10.77
4,447,698 5/1984 Van Sikle et al. ..... 219/110
4,456,803 6/1984 Kaneda et al. ..... 219/8.5
4,634,830 1/1987 Furudate ..... 219/110 X

*Primary Examiner*—Philip H. Leung
*Attorney, Agent, or Firm*—Bachman & LaPointe

[57] ABSTRACT

A method of measuring an effective heating power applied to a workpiece at a position to be heated by a high frequency heating apparatus having a source of high frequency AC power connected to a resonant circuits having a supply of high frequency AC power from the source for applying a high frequency AC power to the workpiece. An effective power $P_{HF}$ for the power supplied to the resonance circuit is measured. An effective value $I_t$ for the current sensed in the resonance circuit is measured. A power loss W produced in components following the source is calculated as a function of the measured effective value $I_t$. The effective heating power Pw is calculated as $Pw=P_{HF}-W$. In another aspect of the invention, the calculated effective heating power Pw is compared with a target value. The power to the resonance circuit is controlled in a direction zeroing the difference between the calculated effective heating power and the target value.

9 Claims, 7 Drawing Sheets

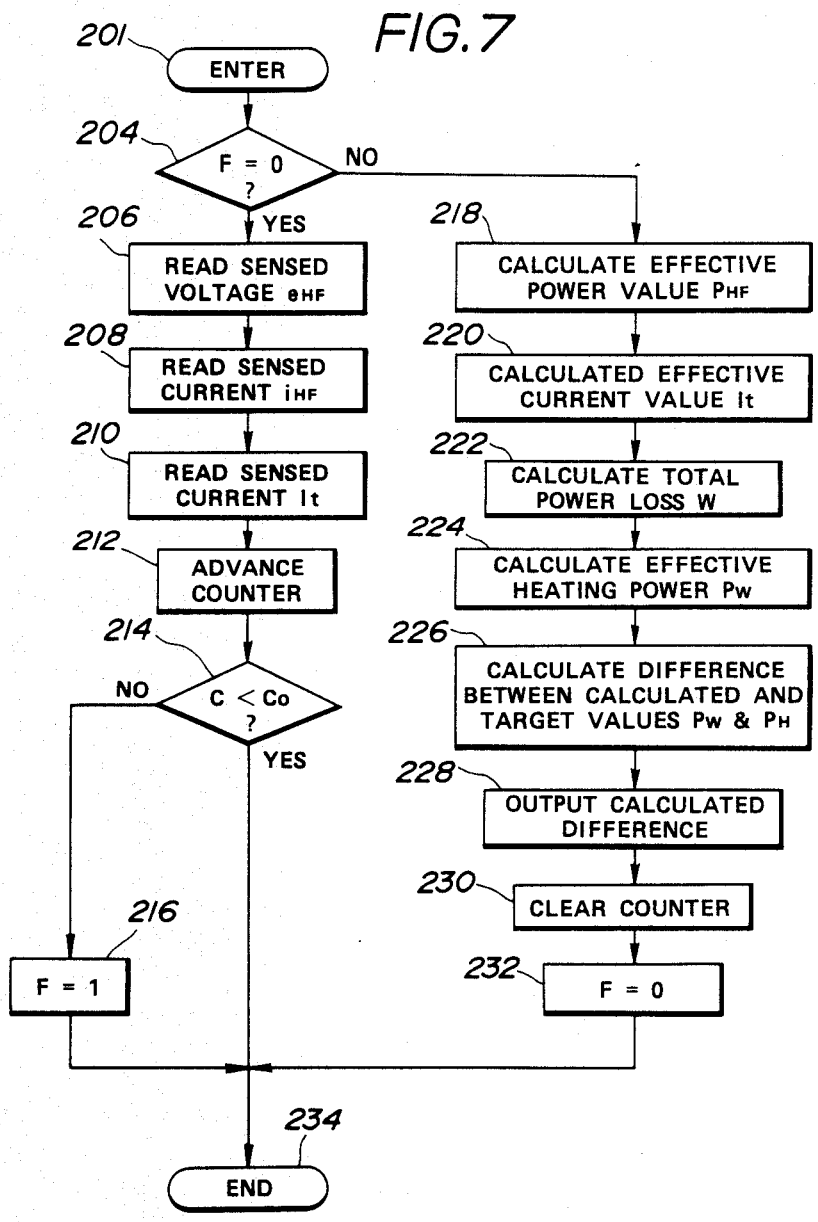
FIG. 7
201
ENTER
204
F = 0 ?
NO
YES
206
READ SENSED VOLTAGE eHF
208
READ SENSED CURRENT iHF
210
READ SENSED CURRENT It
212
ADVANCE COUNTER
214
C < Co ?
NO
YES
216
F = 1
218
CALCULATE EFFECTIVE POWER VALUE PHF
220
CALCULATED EFFECTIVE CURRENT VALUE It
222
CALCULATE TOTAL POWER LOSS W
224
CALCULATE EFFECTIVE HEATING POWER Pw
226
CALCULATE DIFFERENCE BETWEEN CALCULATED AND TARGET VALUES Pw & PH
228
OUTPUT CALCULATED DIFFERENCE
230
CLEAR COUNTER
232
F = 0
234
END

METHOD FOR MEASURING EFFECTIVE HEATING POWER FOR HIGH FREQUENCY HEATING

BACKGROUND OF THE INVENTION

This invention relates to a method of measuring an effective heating power applied to a workpiece at a position to be heated by a high-frequency heating apparatus.

High-frequency heating apparatus employ an oscillating circuit for converting AC power into high-frequency AC power to develop an electric potential in a workpiece, causing heating because of $I^2R$ losses. However, it is very difficult to provide direct measurement of the effective heating power applied to the workpiece at a position to be heated since there is no device capable of measuring AC power at a high frequency exceeding 20 kHz. For this reason, it is the current practice to infer the effective heating power from the DC power applied to the oscillating circuit, resulting in poor accuracy of measurement of the effective heating power.

SUMMARY OF THE INVENTION

Therefore, it is a main object of the invention to provide a method which can provide accurate measurement of the effective heating power applied to a workpiece at a position to be heated by a high-frequency heating apparatus.

Another object of the invention is to provide a method which can provide accurate control of the effective heating power applied to a workpiece at a position to be heated by a high-frequency heating apparatus.

There is provided, in accordance with the invention, a method of measuring an effective heating power applied to a workpiece at a position to be heated by a high frequency heating apparatus having a source of high frequency AC power connected through a conductor to a resonant circuit having a supply of high frequency AC power from the source for inducing a high frequency AC power in the workpiece. The method comprises the steps of sensing a first current flowing through the conductor, sensing a voltage appearing on the conductor, sensing a second current at a position in the resonant circuit, sampling instantaneous values of the sensed first current at a predetermined time intervals to provide information on the waveform of the sensed first current, sampling instantaneous values of the sensed voltage at the predetermined time intervals to provide information on the waveform of the sensed voltage, sampling instantaneous values of the sensed second current at predetermined time intervals to provide information on the waveform of the sensed second current, calculating an effective value $P_{HF}$ for the power supplied through the conductor to the resonance circuit from the sampled instantaneous values of the sensed first current and the sampled instantaneous values of the sensed voltage, calculating an effective value $I_t$ for the sensed second current from the sampled instantaneous values of the sensed second current, calculating a power loss W produced in components following the source as a function of the calculated effective value $I_t$, and calculating the effective heating power Pw as $Pw = P_{HF} - W$.

In another aspect of the invention, a difference between the calculated effective heating power and a target value is determined. The power to the resonance circuit is controled in a direction zeroing the calculated difference.

BRIEF DESCRIPTION OF THE DRAWINGS

The present invention will be described in greater detail by reference to the following description taken in connection with the accompanying drawings, in which:

FIG. 7 is a flow diagram illustrating the programming of the digital computer as it is used to control the effective heating power;

DETAILED DESCRIPTION OF THE INVENTION

Figure 1:
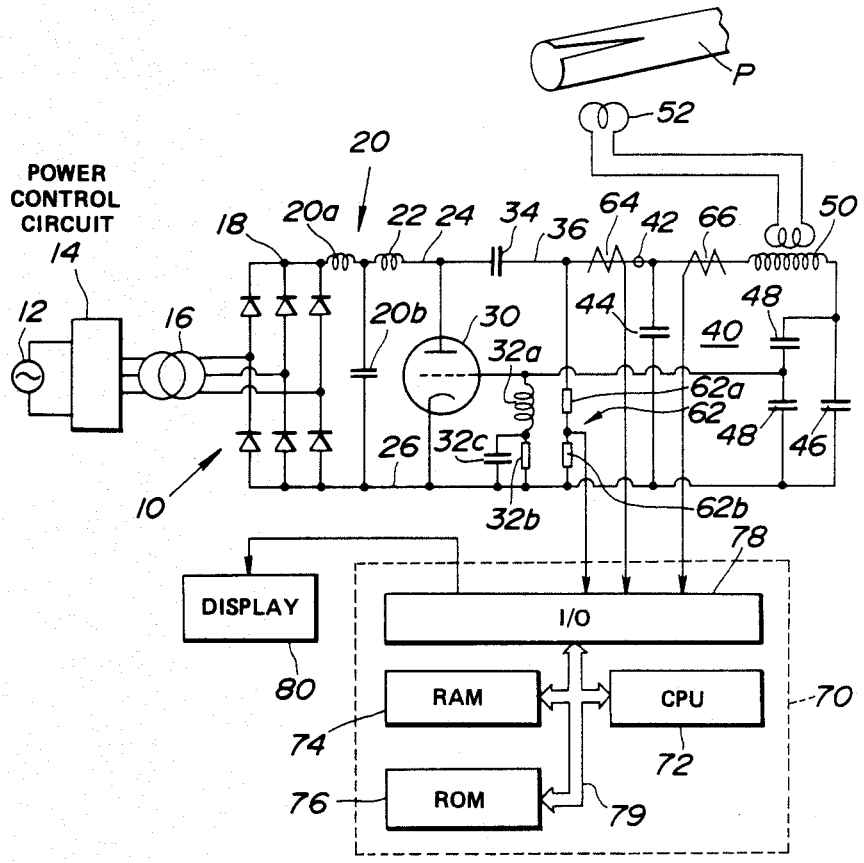
FIG. 1 is a circuit diagram showing one example of high-frequency heating apparatus to which one embodiment of the invention is applied.

With reference to the dawings, and in perticular to FIG. 1, there is shown a circuit diagram of a high-frequency heating apparatus. The high-frequency heating apparatus includes a power section, generally designated by the numeral 10, for generating a high-frequency AC power. The power section 10 includes an AC power source 12 connected to a power control circuit 14 for adjusting the AC power applied to a transformer 16. The output of the power control circuit 14 is connected to the primary winding of the transformer 16, the secondary winding of which is connected to a rectifier 18. The rectifier 18 rectifies the AC power from the transformer 16. The output of the rectifier 18 is connected to a low pass filter 20 which is shown as including a winding **20*a* and a capacitor 20*b* connected in well known manner to smooth the commuator ripple current. The output of the low pass filter 20 is connected through a choke coil 22 to the conductor 24. Thse components 12–22 constitute a DC power source for generating a DC power between conductors 24 and 26**.

The power section 10 also includes an oscillating tube 30 for converting the DC power into a high-frequency AC power. The oscillating tube 30 has an anode connected to the conductor 24, a cathode connected to the conductor 26, and a grid connected to the conductor 26 through a series circuit of a winding **32*a*** and a resistor 32*b* paralleled by a capacitor 32*c*. The anode of the oscillating tube 30 is connected through a DC blocking capacitor 34 to a conductor 36 on which the high-frequency power appears. It is to be noted that the oscillating tube 30 may be replaced with another device such as a thyristor switching circuit or the like capable of converting an DC power into a high-frequency AC power at a frequency ranging 10 kHz to 500 kHz.

The high-frequency heating apparatus also includes a tank or resonance circuit, generally designated by the numeral 40, for storing energy over a band of frequencies continuously distributed about a resonant frequency. The tank circuit 40 has an input terminal 42 connected to the conductor 36. The tank circuit 40 includes a capacitor 44 connected at its one end to the input terminal 42 and at the other end thereof to the conductor 26. The tank circuit 40 also includes a matching transformer 50 having a primary winding connected at its one end to the input terminal 42 and at the other end thereof to the conductor 26 through a capacitor 46 paralleled by a series circuit of two capacitors 48. The junction of the capacitors 48 is connected to the grid of the oscillating tube 30.

Figure 2:
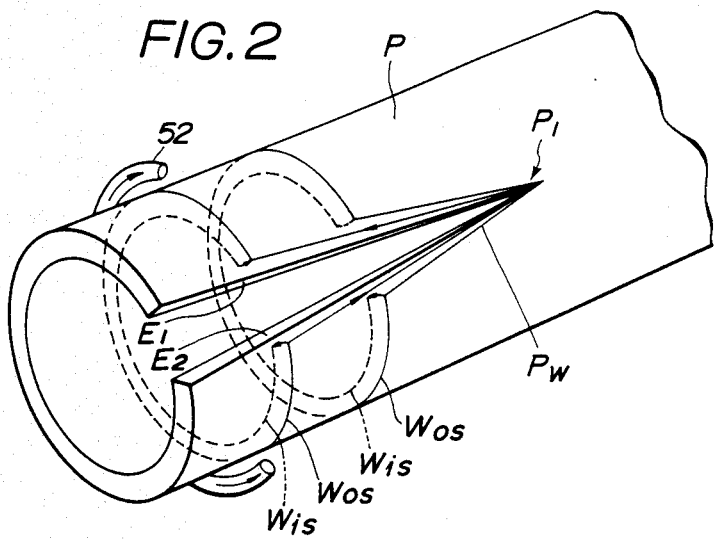
FIG. 2 is a fragmentary perspective view showing one example of workpiece to be heated by the high-frequency heating apparatus.

The secondary winding of the matching transfomer 50 is connected to a heating coil 52 held close to a workpiece P. In the illustrated case, the workpiece P is a sheet-formed member curved, for example, by means of rollers, and the high-frequency heating apparatus is applied to weld the opposite side edges of the workpiece P to produce a pipe-shaped member by producing a highly concentrated, rapidly alternating magnetic field in the heating coil 52 to induce an electric potential in the workpiece P, causing heating because of $I^2R$ losses at a position where welding is required, as shown in FIG. 2.

The effective heating power (Pw) induced in the workpiece P at a point P1 (see FIG. 2) where welding is required, this being determined by the effective power ($P_{HF}$) produced at the output terminal 38 of the power section 10, the power loss ($W_E$) produced in the transmission circuit between the power section 10 to the workpiece P, and the power loss ($W_L$) produced in the workpiece P, is measured from calculations performed by a digital computer 70. For this purpose, a voltage sensor 62, a first current sensor 64 and a second current sensor 66 are connected to the digital computer 70.

The voltage sensor 62 is provided at a position for sensing the voltage $e_{HF}$ developed on the conductor 36. The voltage sensor 62 preferably is a voltage divider having two resistors 62*a* and 62*b* connected in series between the conductors 26 and 36. The junction of the resistors 62*a* and 62*b* is connected to the digital computer 70. The first current sensor 64 is provided at a position for sensing the current $i_{HF}$ flowing through the conductor 36. The first current sensor 64 preferably is a high-frequency current transformer provided around the conductor 36. The output of the high-frequency current transformer is connected to the digital computer 70. The second current sensor 66 is provided at a position for sensing the current $i_t$ flowing to the primary winding of the matching transformer 50. The second current sensor 66 preferably is a large-current high-frequency transformer provided around the conductor extending to the matching transformer primary winding. The output of the second current sensor 66 is connected to the digital computer 70.

The digital computer 70 is a general purpose digital computer capable of performng the arithmetic calculations of addition, subtraction, multiplication, and division on binary numbers. The digital computer 70 comprises a central processing unit (CPU) 72 in which the actual arithmetic calculations are performed, a random access memory (RAM) 74, a read only memory (ROM) 76, and an input/output control circuit (I/O) 78. The central processing unit 72 communicates with the rest of the computer via data bus 79. The input/output control circuit 78 includes an analog multiplexer and an analog-to-digital converter. The analog-to-digital converter is used to convert the analog sensor signals comprising the inputs to the analog multiplexer into digital form for application to the central processing unit 72. The A to D conversion process is initiated on command from the central processing unit 72. The read only memory 76 contains the program for operating the central processing unit 72 and further contains appropriate data used in calculating appropriate values for effective heating power.

The digital computer 70 samples instantaneous values of the sensor signal inputted from the voltage sensor 62 to the analog multiplexer, instantaneous values of the sensor signal inputted from the first current sensor 64 to the analog multiplexer, and instantaneous values of the sensor signal inputted from the second current sensor 66 to the analog multiplexer at predetermined time intervals. The sampled instantaneous values of the sensed voltage $e_{HF}$ are read into the computer memory 74 to provide data on the waveform of the sensed voltage $e_{HF}$. The sampled instantaneous values of the sensed current $i_{HF}$ are read into the computer memory 74 to provide data on the waveform of the sensed current $i_{HF}$. The sampled instantaneous values of the sensed current $i_t$ are read into the computer memory 74 to provide data on the waveform of the sensed current $i_t$.

The digital computer 70 calculates the effective value $P_{HF}$ of the power developed on the conductor 36 by the power section 10 in terms of the stored data $e_{HF}$ and $i_{HF}$ as $$P_{HF} = \sqrt{\frac{1}{T}\int_o^T (e_{HF} \times i_{HF})^2 \cdot dt}$$

where T is the period of the sensed voltage $e_{HF}$ and the sensed current $i_{HF}$. The digital computer 70 also calculates the effective value $I_t$ of the sensed current $i_t$ in terms of the stored data $i_t$ as $$I_t = \sqrt{\frac{1}{T}\int_o^T i_t^2 \cdot dt}$$

where T is the period of the sensed current $i_t$.

The digital computer 70 calculates the effective heating power Pw developed at the point P1 where welding is required as $$We = P_{HF} = (W_E + W_L)$$

where $W_E$ is a first power loss produced during power transmission to the workpiece P and $W_L$ is a second power loss produced in the workpiece P. The first power loss $W_E$ is the sum of a transmission loss Wtr produced in the tank circuit 40 and a coil loss Wc produced in the heating coil 52. The second power loss $W_L$ is the sum of a power loss Wos produced when current flows in the workpiece P near its outer peripheral surface and a power loss Wis produced when current flows in the workpiece P near its inner peripheral surface, as shown in FIG. 2. The first power loss $W_E$ is calculated as $$W_E = K0 \times I_t^A$$

where K0 is a constant and A is an exponent ranging from 1.8 to 2.2. The second power loss $W_L$ is calculated as $$W_L = K1 \times I_t^B$$

where K1 is a constant and B is an exponent ranging from 1.8 to 2.2. Thus, the effective heating power Pw is calculated as $$Pw = P_{HF} - (K0 \times I_t^A + K1 \times I_t^B)$$

The constants K0 and K1 and the exponents A and B are determined experimentally in the following manner:

In order to determine the constant K0 and the exponent A, the workpiece P is removed from the heating coil 52. When the workpiece P is removed from the heating coil 52, the calculated effective power $P_{HFO}$ represents the first power loss $W_E$ and also corresponds to $K0 \times I_{t0}^A$ where $I_{t0}$ is the effective value of the current $i_t$ sensed by the second current sensor 66 under this condition. Thus, we obtain $$W_E = P_{HFO} = K0 \times I_{t0}^A$$

Taking logarithms of the both sides of this equation, we obtain $$\log P_{HFO} = \log (K0 \times I_{t0}^A)$$

The properties of logarithms allow us to rewrite this equation as $$\log P_{HFO} = \log K0 + A \log I_{t0}$$

A series of tests are performed on a given high-frequency heating apparatus with the workpiece P being removed from the field of the heating coil 52 to determine the constant K0 and the exponent A. The testing includes the operation of the high-frequency heating apparatus at a number of possible DC power levels to the oscillating tube 30. The calculated values for the log $P_{HFO}$ are plotted with respect to the calculated values for the log $I_{t0}$ on an orthogonal coordinate system with the log $I_{t0}$ as the x-coordinate axis and the log $P_{HFO}$ as the y-coordinate axis. It is to be noted that the relationship between the log $P_{HFO}$ and the (log K0 +. A log $I_{t0}$) is represented as a line on the orthogonal coordinate system. The value for the log K0 is obtained as the intersection of the line on the y-coordinate axis and the exponent A is obtained as the inclination of the line with respect to the x-coordinate axis.

Figure 3:
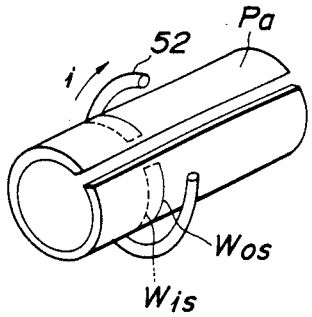
FIG. 3 is a perspective view showing a dummy used in connection with the workpiece of FIG. 2.
Figure 4:
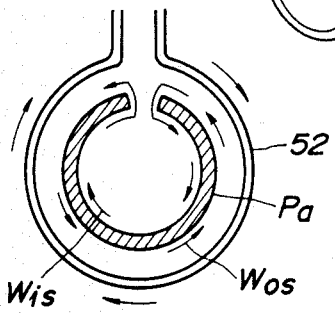
FIG. 4 is a sectional view showing the dummy of FIG. 3.

In order to determine the constant K1 and the exponent B, a dummy Pa is positioned in place of the workpiece P. As shown in FIGS. 3 and 4, the dummy Pa is a sheet-formed member curved so as to have its opposite side edges separated at a small distance from each other so as to have no portion to be heated. The dummy Pa is made of the same material as the workpiece P and it has the same dimensions as the workpiece P. When the high-frequency heating apparatus operates under this condition, current flows in the dummy Pa near its outer peripheral surface to produce the power loss Wos and near its inner peripheral surface to produce the power loss Wis. The second power loss $W_L$, which is the sum of the power losses Wos and Wis, is represented as the calculated effective power $P_{HF1}$ minus the calculated first power loss $W_E$ and it corresponds to $K1 \times I_{t1}^B$ where $I_{t1}$ is the effective value of the current $i_t$ sensed by the second current sensor 66 under this condition. Thus, we obtain $$W_L = P_{HF1} - W_E = K1 \times I_{t1}^B$$

A series of tests are performed on the high-frequency heating apparatus with the dummy Pa being positioned in place of the workpiece P to determine the constant K1 and the exponent B substantially in the same manner as described previously in connection with the determination of the constant K0 and the exponent A.

The determined constants K0 and K1 and the determined exponents A and B are stored in the computer memory 74. Once the constants K0 and K1 and the exponents A and B have been obtained for a particular type of high-frequency heating apparatus, the effective heating power for all high-frequency heating apparatus of this type can be calculated accordingly.

Figure 5:
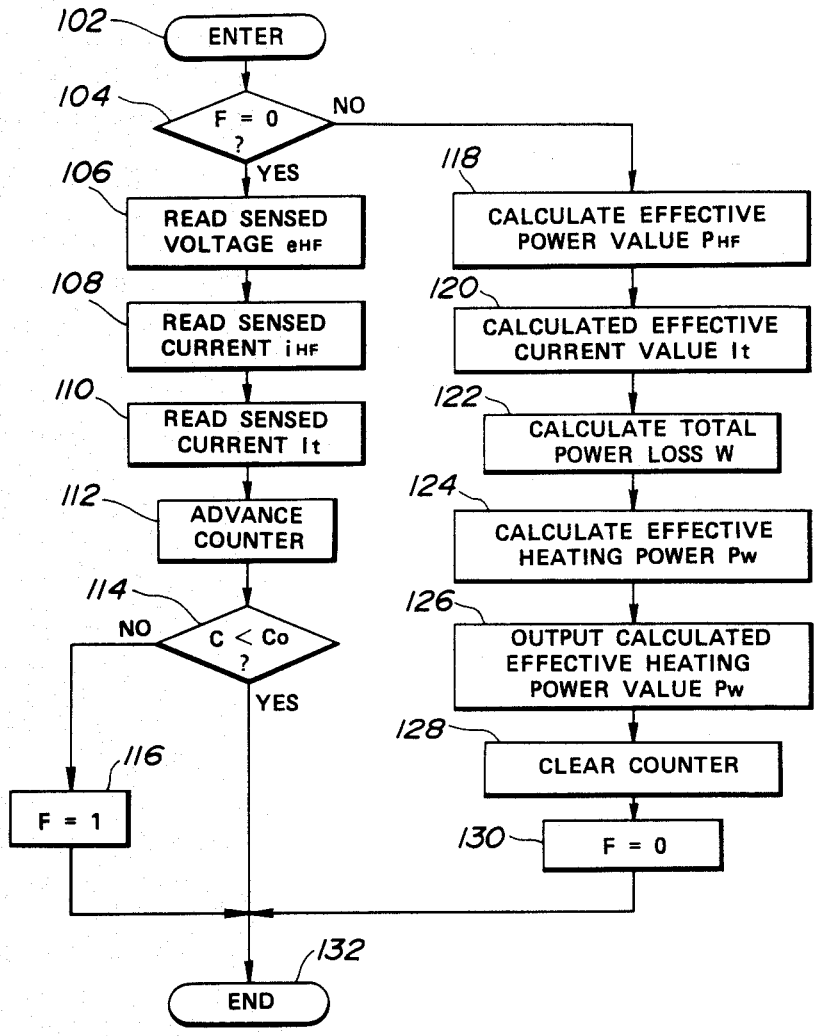
FIG. 5 is a flow diagram illustrating the programming of the digital computer as it is used to measure the effective heating power.

FIG. 5 is a flow diagram illustrating the programming of the digital computer 70 as it is used to measure the effective heating power developed in the workpiece P at a point P1 where heating is required.

The computer program is entered at the point 102 at predetermined time intervals. At the point 104 in the program, a determination is made as to whether or not a flag is cleared. If the flag is cleared, the program proceeds to the point 106 where the sensor signal $e_{HF}$ fed from the voltage sensor 62 is converted to digital form and read into the computer memory 74. Similarly, at the point 108, the sensor signal $i_{HF}$ fed from the first current sensor 64 is converted to digital form and read into the computer memory 74. At the point 110 in the program, the sensor signal $i_t$ fed from the second current sensor 66 is converted to digital form and read into the computer memory 74.

At the point 112 in the program, the central processing unit 72 provides a command to cause a counter to coupt up by one step. The counter accumulates a count C which indicates the number of times of sampling of the instantaneous values of each of the sensor signals $e_{HF}$, $i_{HF}$ and $i_t$. Following this, the program proceeds to a determination step at the point 114. This determination is as to whether or not the count C accumulated in the counter is less than a predetermined value Co. If the answer to this question is "yes", then the program proceeds to the end point 132. Otherwise, the program proceeds to the point 116 where the flag is set to indicate that the digital computer has sampled a sufficient number of instantaneous values to provide data on the waveform of each of the sensor signals $e_{HF}$, $i_{HF}$ and $i_t$. Following this, the program proceeds to the end point 132.

If the answer to the question inputted at the point 104 is "no", then it means that the digital computer has sampled a sufficient number of instantaneous values to provide data on the waveform of each of the sensor signals $e_{HF}$, $i_{HF}$ and $i_t$, and the program proceeds to the point 118. At this point, the central processing unit 72 calculates an effective value $P_{HF}$ for the power developed on the line 36 from the stored data as $$P_{HF} = \sqrt{\frac{1}{T} \int_{o}^{T} (e_{HF} \times i_{HF})^2 \cdot dt}$$

At the point 120 in the program, the central processing unit 72 calculates an effective value $I_t$ for the current $i_t$ from the stored data as $$I_t = \sqrt{\frac{1}{T} \int_{o}^{T} i_t^2 \cdot dt}$$

At the point 122 in the program, a power loss W is calculated from a relationship programmed into the computer. This relation defines the power loss W as a function of the calculated effective value $I_t$ as $$W = K0 \times I_t^A + K1 \times I_t^B$$

where K0 and K1 are constants stored previously in the computer memory 74 and A and B are exponents stored previously in the computer memory 74. At the point 124 is the program, an effective power Pw is calculated from a relationship programmed into the computer. This relationship defines the effective heating power Pw as $$Pw = H_{HF} - W$$

At the point 126 in the program, the central processing unit 72 transfers the calculated effective heating power Pw to indicate it on a display device 80. After the counter is cleared to zero at the point 128 and the flag is cleared to zero at the point 130, the program proceeds to the end point 132.

Figure 6:
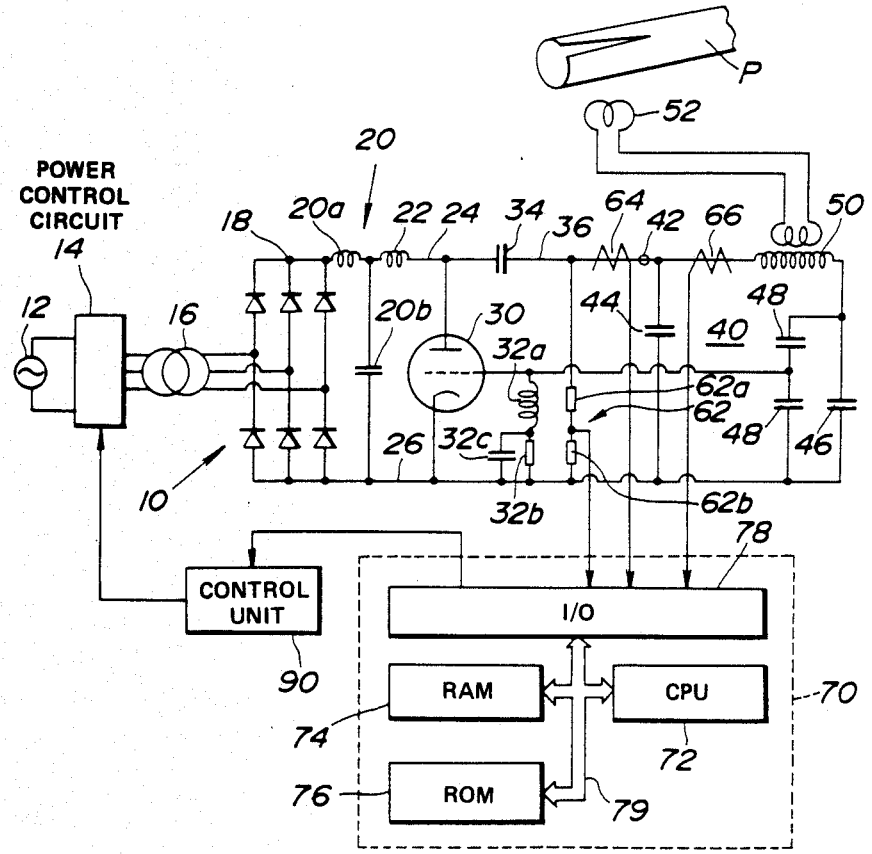
FIG. 6 is a circuit diagram showing one example of high-frequency heating apparatus to which another embodiment of the invention is applied.

Referring to FIG. 6, there is illustrated a second embodiment of the invention which is substantially the same as the first embodiment except that the digital computer 70 is used with a control unit 90 for adjusting the measured effective heating power Pw to a target value $P_H$. Accordingly, parts in FIG. 6 which are like those in FIG. 1 have been given the same reference numeral. In this embodiment, the digital computer 70 calculates a difference between the calculated effective heating power Pw and the target value $P_H$ and causes the control unit 90 to control the power control circuit 14 which thereby controls the DC power to the oscillating tube 30 in a direction reducing the calculated difference to zero.

FIG. 7 is a flow diagram illustrating the programming of the digital computer 70 as it is used to adjust the effective heating power to a target value.

The computer program is entered at the point 202 at predetermined time intervals. At the point 204 in the program, a determination is made as to whether or not a flag is cleared. If the flag is cleared, the program proceeds to the point 206 where the sensor signal $e_{HF}$ fed from the voltage sensor 62 is converted to digital form and read into the computer memory 74. Similarly, at the point 208, the sensor signal $i_{HF}$ fed from the first current sensor 64 is converted to digital form and read into the computer memory 74. At the point 210 in the program, the sensor signal $i_t$ fed from the second current sensor 66 is converted to digital form and read into the computer memory 74.

At the point 212 in the program, the central processing unit 72 provides a command to cause a counter to count up by one step. The counter accumulates a count C which indicates the number of times of sampling of the instantaneous values of each of the sensor signals $e_{HF}$, $i_{HF}$ and $i_t$. Following this, the program proceeds to a determination step at the point 214. This determination is as to whether or not the count C accumulated in the counter is less than a predetermined value Co. If the answer to this question is "yes", then the program proceeds to the end point 234. Otherwise, the program proceeds to the point 216 where the flag is set to indicate that the digital computer has sampled a sufficient number of instantaneous values to provide data on the waveform of each of the sensor signals $e_{HF}$, $i_{HF}$ and $i_t$. Following this, the program proceeds to the end point 234.

If the answer to the question inputted at the point 204 is "no", then it means that the digital computer has sampled a sufficient number of instantaneous values to provide data on the waveform of each of the sensor signals $e_{HF}$, $i_{HF}$ and $i_t$, and the program proceeds to the point 218. At this point, the central processing unit 72 calculates an effective value $P_{HF}$ for the power developed on the line 36 from the stored data as $$P_{HF} = \sqrt{\frac{1}{T} \int_{o}^{T} (e_{HF} \times i_{HF})^2 \cdot dt}$$

At the point 220 in the program, the central processing unit 72 calculates an effective value $I_t$ for the current $i_t$ from the stored data as $$I_t = \sqrt{\frac{1}{T} \int_{o}^{T} i_t^2 \cdot dt}$$

At the point 222 in the program, a power loss w is calculated from a relationship programmed into the computer. This relation defines the power loss W as a function of the calculated effective value $I_t$ as $$W = K0 \times I_t^A + K1 \times I_t^B$$

where K0 and K1 are constants stored previously in the computer memory 74 and A and B are exponents stored previously in the computer memory 74. At the point 224 in the program, an effective power Pw is calculated from a relationship programmed into the computer. This relationship defines the effective heating power Pw as $$Pw = P_{HF} - W$$

At the pint 226 in the program, a difference between the calculated value Pw and the target value $P_H$ is calculated. At the point 228, the central processing unit 72 transfers the calculated difference to the control unit 90, causing the power control circuit 14 to control the DC power to the oscillating tube 30 in a direction reducing the calculated difference to zero; that is, adjusting the measured effective heating power Pw to the target value $P_H$. After the counter is cleared to zero at the point 230 and the flag is cleared to zero at the point 232, the program proceeds to the end point 234.

Once ther effective heating power Pw has been measured, the magnitude $P_{DC}$ of the DC power supplied to the oscillating tube 30 can be caculated from the following equation:

$$P_{DC}=(Pw+K0\times I_t^A+K1\times I_t^B)/\eta osc$$

where $\eta osc$ is the oscillating efficiency.

Figure 8:
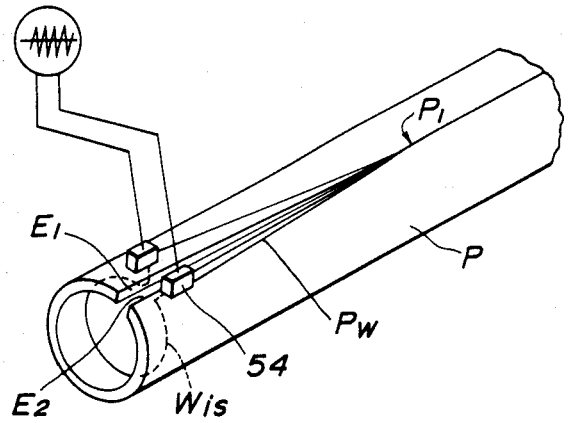
FIGS. 8 through 10 show a modified form of the high-frequency heating apparatus.
Figure 9:
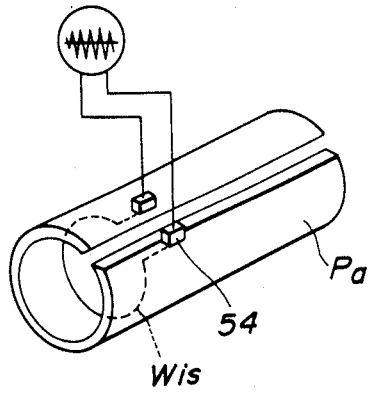
Figure 10:
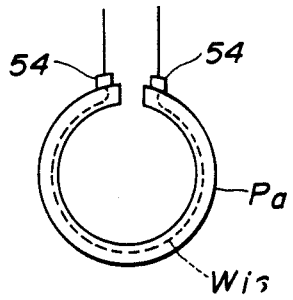

Although the invention has been described in connection with a high-frequency heating apparatus employing a heating coil for inducing an electric potential in the workpiece P, it is to be noted that the high-frequency heating apparatus is not limited in any way to such a type and the heating coil may be replaced with a pair of contacts 54 placed in contact with the workpiece P on the opposite sides of a line along which welding is required, as shown in FIG. 8. FIGS. 9 and 10 show the manner in which the contacts 54 are placed on the dummy Pa in determining the constant K1 and the exponent B used in calculating an effective heating power developed at the point P1 (see FIG. 8). In this case, the effective heating power Pw developed in the workpiece P at a point P1 where welding is required is measured in the same manner as described in connection with the first and second embodiments. In addition, although the high-frequency heating apparatus has been shown and described as including a high-frequency power source of the type employing an oscillating tube, it is to be noted that the high-frequency power source is not limited in any way to this type.

Figure 11A:
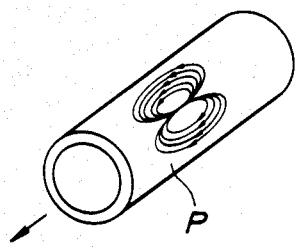
FIG. 11(A) is a perspective view showing another type of workpiece applicable to the inventive method.
Figure 11B:
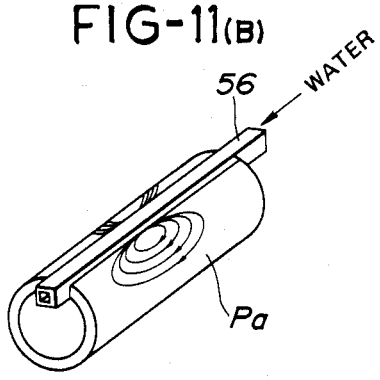
FIG. 11(B) is a perspective view showing a dummy used in connection with the workpiece of FIG. 11(A)

Although the high-frequency heating apparatus has been shown and described as being used to weld the opposite side edges of a sheet-formed workpiece P to produce a pipe-shaped member, it is to be noted that it may be used to heat a linear portion of a pipe-shaped workpiece P, as shown in FIG. 11(A), while moving the workpiece in a direction indicated by the arrow. Fig. 11(B) shows a dummy Pa used to determine the constant K1 and the exponent B used in calculating an effective heating power developed in the workpiece linear portion where heating is required. In this case, the dummy Pa is substantially the same as the workpiece P excedpt that a water-cooled conduit 56 is placed in the dummy Pa at a position corresponding to the workpiece linear portion to be heated for supressing heat generation thereon. The water-cooled conduit 56 is made of copper or other materials having such an extremely low electrical resistance as to produce substantially no power loss thereon.

Figure 12A:
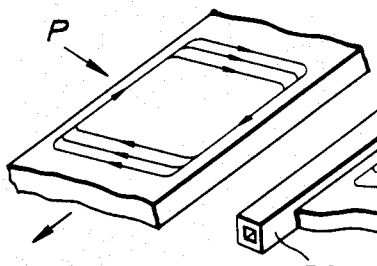
FIG. 12(A) is a fragmentary perspective view showing still another example of workpiece applicable to the inventive method.
Figure 12B:
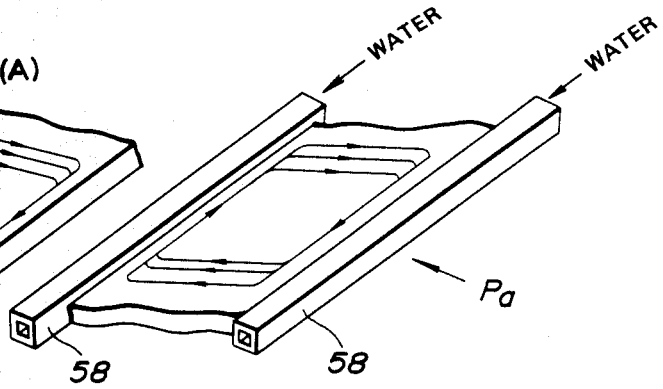
FIG. 12(B) is a fragmentary perspective view showing a dummy used in connection with the workpiece of FIG. 12(A).

In addition, the high-frequency heating apparatus may be used to heat the opposite side edges of a sheet-formed workpiece P, as shown in FIG. 12(A), while moving the workpiece P in a direction indicated by the arrow. FIG. 12(B) shows a dummy Pa used to determine the constant K1 and the exponent B used in calculating an effective heating power developed in the workpiece opposite side edges to be heated. The dummy Pa is substantially the same as the workpiece P except that two water-cooled conduits 58 are secured respectively on the workpiece opposite side edges to be heated for suppressing heat generation thereon. The water-cooled conduits 58 are made of copper or other materials having such an extremely low electrical resistance as to produce substantially no power loss thereon.

What is claimed is:

1. A method of controlling high frequency heating apparatus having a source of high frequency AC power connected through a conductor to a resonant circuit having a supply of high frequency AC power from the source for applying a high frequency AC power to a workpiece, comprising the steps of:

sensing a first current flowing through the conductor;

sensing a voltage appearing on the conductor;

sensing a sound current at a position in the resonant circuit;

sampling the sensed first current at predetermined time intervals to provide information on the waveform of the sensed first current;

sampling the sensed voltage at predetermined time intervals to provide information on the waveform of the sensed voltage;

sampling the sensed second current at predetermined time intervals to provide information on the waveform of the sensed second current;

calculating an effective value $P_{HF}$ for the power supplied through the conductor to the resonance circuit from the sampled values of the sensed first current and the sampled values of the sensed voltage;

calculating an effective value $I_t$ for the sensed second current from the sampled values of the sensed second current;

calculating a power loss W produced in components following the source as a function of the calculated effective value $I_t$;

calculating a value Pw as a $Pw=P_{HF}-W$; and outputting the calculated value Pw as a measured value for an effective heating power applied to the workpiece at a position to be heated.

2. The method as claimed in claim 1, wherein the power loss W is a first power loss $W_E$ plus a second power loss $W_L$, the first power loss $W_E$ being calculated as $W_E=K0\times I_t^A$ where K0 is a constant and A is an exponent ranging from 1.8 to 2.2, the second power loss $W_L$ being calculated as $W_L=K1\times I_t^B$ where K1 is a constant and B is an exponent ranging from 1.8 to 2.2.

3. The method as claimed in claim 2, wherein the step of calculating a power loss W including the steps of:

sensing a third current flowing through the conductor in the absence of the workpiece;

sensing a second voltage appearing on the conductor in the absence of the workpiece;

sensing a fourth current at a position in the resonant circuit in the absence of the workpiece;

sampling the sensed third current at predetermined time intervals to provide information on the waveform of the sensed third current;

sampling the sensed voltage at predetermined time intervals to provide information on the waveform of the sensed second voltage;

calculating an effective value $P_{HF0}$ for the power supplied through the conductor to the resonance circuit from the sampled values of the sensed third current and the sampled values of the sensed second voltage;

calculating an effective value $I_{t0}$ for the sensed fourth current from the sampled values of the sensed fourth current;

determining the constant Ko and the exponent A from a relationship represented as $P_{HF0}=K0\times I_{t0}^A$;

sensing a fifth current flowing through the conductor with a dummy being positioned in place of the workpiece, the dummy being similar to the workpiece except for the dummy having no portion to be heated;

sensing a third voltage appearing on the conductor with the dummy being positioned in place of the workpiece;

sensing a sixth current at a position in the resonant circuit with the dummy being positioned in place of the workpiece;

sampling the sensed fifth current at predetermined time intervals to provide information on the waveform of the sensed fifth current;

sampling the sensed third voltage at predetermined time intervals to provide information on the waveform of the sensed third voltage;

sampling the sensed sixth current at predetermined time intervals to provide information on the waveform of trhe sensed sixth current;

calculating an effective value $P_{HF1}$ for the power supplied through the conductor to the resonance circuit from the sampled values of the sensed fifth current and the sampled values of the sensed third voltage;

calculating an effective value $I_{t1}$ for the sensed sixth current from the sampled values of the sensed forth current; and determining the constant K1 and the exponent B from a relationship represented as $P_{HF1}-W_E=K1\times I_{t1}^A$.

4. The method as claimed in claim 1, which further comprises the steps of:

setting a target value for the effective heating power;

calculating a difference between the calculated effective heating power and the target value; and adjusting the power to the resonance circuit in a direction zeroing the calculated difference.

5. The method as claimed in claim 4, wherein the power loss W is a first power loss $W_E$ plus a second power loss $W_L$, the first power loss $W_e$ being calculated as $W_E=K0\times I_t^A$ where K0 is a constant and A is an exponent ranging from 1.8 to 2.2, the second power loss $W_L$ being calculated as $W_L=K1\times I_t^B$ where K1 is a constant and B is an exponent ranging from 1.8 to 2.2.

6. The method as claimed in claim 5, wherein the step of calculating a power loss W including the steps of:

sensing a third current flowing through the conductor in the absence of the workpiece;

sensing a second voltage appearing on the conductor in the absence of the workpiece;

sensing a fourth current at a position in the resonant circuit in the absence of the workpiece;

sampling the sensed third current at predetermined time intervals to provide information on the waveform of the sensed third current;

sampling the sensed voltage at predetermined time intervals to provide information on the waveform of the sensed second voltage;

calculating an effective value $P_{HF0}$ for the power supplied through the conductor to the resonance circuit from the sampled values of the sensed third current and the sampled values of the sensed second voltage;

calculating an effective value $I_{t0}$ for the sensed fourth current from the sampled values of the sensed fourth current;

determining the constant K0 and the exponent A from a relationship represented as $P_{HF0}=K0\times I_{t0}^A$;

sensing a fifth current flowing through the conductor with a dummy being positioned in place of the workpiece, the dummy being similar to the workpiece except for the dummy having no portion to be heated;

sensing a third voltage appearing on the conductor with the dummy being positioned in place of the workpiece;

sensing a sixth current at a position in the resonant circuit with the dummy being positioned in place of the workpiece;

sampling the sensed fifth current at predetermined time intervals to provide information on the waveform of the sensed fifth current;

sampling the sensed third voltage at predetermined time intervals to provide information on the waveform of the sensed third voltage;

sampling the sensed sixth current at predetermined time intervals to provide information on the waveform of the sensed sixth current;

calculating an effective value $P_{HF1}$ for the power supplied through the conductor to the resonance circuit from the sampled values of the sensed fifth current and the sampled values of the sensed third voltage;

calculating an effective value $I_{t1}$ for the sensed sixth current from the sampled values of th sensed forth current; and determining the constant K1 and the exponent B from a relationship represented as $P_{HF1}-W_E=K1\times I_{t1}^A$.

7. A method of controlling an effective heating power caused in a workpiece at a position to be heated by a high frequency heating apparatus having a source of high frequency AC power connected through a conductor to a resonant circuit having a supply of high frequency AC power from the source for applying a high frequency AC power to the workpiece, comprising the steps of:

setting a target value for the effective heating power;

sensing a first current flowing through the conductor;

sensing a voltage appearing on the conductor;

sensing a second current at a position in the resonant circuit;

sampling the sensed first current at predetermined time intervals to provide information on the waveform of the sensed first current;

sampling the sensed voltage at predetermined time intervals to provide information on the waveform of the sensed voltage;

sampling the sensed second current at predetermined time intervals to provide information on the waveform of the sensed second current;

calculating an effective value $P_{HF}$ for the power supplied through the conductor to the resonance circuit from the sampled values of the sensed first current and the sampled values of the sensed voltage;

calculating an effective value $I_t$ for the sensed second current from the sampled values of the sensed second current;

calculating a power loss W produced in components following the source as a function of the calculated effective value $I_t$;

calculating the effective heating power Pw as $Pw=P_{HF}-W$;

determining a difference between the calculated effective heating power and the target value; and adjusting the power to the resonance circuit in a direction zeroing the determined difference.

8. The method as claimed in claim 7, wherein the power loss W is a first power loss $W_E$ plus a second power loss $W_L$, the first power loss $W_E = K0 \times I_t^A$ where K0 is a constant and A is an exponent ranging from 1.8 to 2.2, the second power loss $W_L$ being calculated as $W_L = K1 \times I_t^B$ where K1 is a constant and B is an exponent ranging from 1.8 to 2.2.

9. The method as claimed in claim 8, wherein the step of calculating a power loss W including the steps of:

sensing a third current flowing through the conductor in the absence of the workpiece;

sensing a second voltage appearing on the conductor in the absence of the workpiece;

sensing a fourth current at a position in the resonant circuit in the absence of the workpiece;

sampling values for the sensed third current at predetermined time intervals to provide information on the waveform of the sensed third current;

sampling values for the sensed voltage at predetermined time intervals to provide information on the waveform of the sensed second voltage;

calculating an effective value $P_{HF0}$ for the power supplied through the conductor to the resonance circuit from the sampled values of the sensed third current and the sampled values of the sensed second voltage;

calculating an effective value $I_{t0}$ for the sensed fourth current from the sampled values of the sensed fourth current;

determining the constant Ko and the exponent A from a relationship represented as $P_{HF0} = K0 \times I_{t0}^A$;

sensing a fifth current flowing through the conductor with a dummy being positioned in place of the workpiece, the dummy being similar to the workpiece except for the dummy having no portion to be heated;

sensing a third voltage appearing on the conductor with the dummy being positioned in place of the workpiece;

sensing a sixth current at a position in the resonant circuit with the dummy being positioned in place of the workpiece;

sampling the sensed fifth current at predetermined time intervals to provide information on the waveform of the sensed fifth current;

sampling the sensed third voltage at predetermined time intervals to provide information on the waveform of the sensed third voltage;

sampling the sensed sixth current at predetermined time intervals to provide information on the waveform of the sensed sixth current;

calculating an effective value $P_{HF1}$ for the power supplied through the conductor to the resonance circuit from the sampled values of the sensed fifth current and the sampled values of the sensed third voltage;

calculating an effective value $I_{t1}$ for the sensed sixth current from the sampled values of the sensed forth current; and determining the constant K1 and the exponent B from a relationship represented as $P_{HF1} - W_E = K1 \times I_{t1}^A$.

* * * * *